United States Patent [19]

Hagberg

[11] 4,135,658

[45] Jan. 23, 1979

[54] SERVING DEVICE

[76] Inventor: Bruce E. Hagberg, 1910 Olive La., Wayzata, Minn. 55391

[21] Appl. No.: 809,545

[22] Filed: Jun. 24, 1977

[51] Int. Cl.[2] ..... 312 286;311

[52] U.S. Cl. ..... 232/43.1; 232/44

[58] Field of Search ..... 232/43.1, 43.4, 43.3, 232/44, 33

[56] References Cited

U.S. PATENT DOCUMENTS

| | | | |
|---|---|---|---|
| 932,453 | 8/1909 | Easterling | 232/33 |
| 992,605 | 5/1911 | Schroeder | 232/33 |
| 1,647,275 | 11/1927 | Cursons | 232/43.1 |
| 2, 648,300 | 8/1953 | Beedle | 232/43.4 X |
| 2,730,053 | 1/1956 | Ellithorpe | 232/44 X |
| 2,914,244 | 11/1959 | Wheeler | 232/44 |
| 3,059,840 | 10/1962 | Graber et al. | 232/44 |
| 3,145,918 | 8/1964 | Higgins | 232/43.1 |
| 3,227,505 | 1/1966 | Ambaum | 312/311 |
| 3,237,853 | 3/1966 | Grosswiller | 232/43.3 |
| 3,390,833 | 7/1968 | Harris | 232/43.3 |

*Primary Examiner*—Francis K. Zugel
*Attorney, Agent, or Firm*—Wicks & Nemer

[57] ABSTRACT

A device for serving merchandise located in the interior of a building to a person located outside of the building is disclosed including a frame mounted in an aperture of the building and extending into the interior of the building. In the preferred embodiment, a drawer is slidably mounted in the frame from a first, open position extending out of the frame to the exterior of the building and to a second, closed position located within the frame. A door, pivotally mounted to the frame in conjunction with an elongated member attached to the drawer, close the frame when the drawer is located in its second, closed position. In the preferred embodiment, a second door, pivotally mounted to the drawer, substantially prevents air communication between the exterior and the interior of the building when the drawer is located in its first, open position. In the preferred embodiment, the second door, pivotally mounted to the drawer, abuts with the frame when the drawer is located in a position other than in its second, closed position such that the second door is prevented from opening unless the drawer is located in its second, closed position. A money block is slidably mounted in a trough mounted to the drawer and includes a slot for slidably receiving an abutment member outstanding from the trough for preventing removal of the money block in its first, forward position and for allowing removal of the money block in its second, rearward position.

20 Claims, 5 Drawing Figures

SERVING DEVICE

BACKGROUND

The present invention relates generally to devices for serving merchandise, more particularly to devices for serving food, and more specifically to devices for serving food to customers at a fast food type drive-up window.

With the increasing popularity of fast food type restaurants, drive-up windows allowing customers to order and receive their orders from their motor vehicles without entering the restaurant have been gaining popularity and use, especially among elderly, handicapped, or persons picking up orders for many. A need has arisen for devices for serving merchandise that minimizes the energy loss, is secure against break-in, is easily installed, easy to manufacture, and is of hygienic design.

Specifically, prior to the present invention, sliding glass windows were used at some drive-up windows for serving food at fast food restaurants. Large amounts of air circulation occurred between the interior and exterior of the building when the glass windows were opened, especially when the cooking and serving areas of fast-food type restaurants are subjected to negative ventilation, i.e., are subjected to lower air pressure than the remaining portions of the restaurant and the outside ambient atmosphere. This air circulation caused heat or air conditioning loss from the interior of the building resulting in waste of energy as well as increased expenses. Further, persons in the interior of the building servicing the drive-up windows were subjected to drastic temperature changes causing greatly increased possibility of illness and reduced efficiency. Sliding glass windows are also very prone to break-in.

SUMMARY

Briefly, the present invention provides a device for serving that meets such needs by providing, in the preferred embodiment, a frame arranged to fit an aperture in the wall and extending into the interior of the space and having an open end and means for allowing access to the frame interior from the interior of the space, and a drawer movably mounted within the frame from a first, open position extending out of the frame to a second, closed position located within the frame. When the drawer is located in its second, closed position, the open end of the frame is closed. Additionally, when the drawer is located in its first, open position, air communication between the exterior and the interior of the space is substantially prevented.

It is thus an object of the present invention to provide a novel device for serving.

It is further an object of the present invention to provide such a novel device for serving food.

It is further an object of the present invention to provide such a novel device for serving which minimizes energy loss.

It is further an object of the present invention to provide such a novel device for serving which provides a substantially weather tight seal when the drawer is in its second, closed position.

It is further an object of the present invention to provide such a novel device for serving that substantially prevents air communication between the exterior and the interior of the building when the drawer is located in its first, open position.

It is further an object of the present invention to provide such a novel device for serving including a novel money block.

These and further objects and advantages of the present invention will become clearer in light of the following detailed description of the illustrative embodiment of this invention described in connection with the drawings.

DESCRIPTION OF THE DRAWINGS

The illustrative embodiment may best be described by reference to the accompanying drawings, where.

Figure 1:
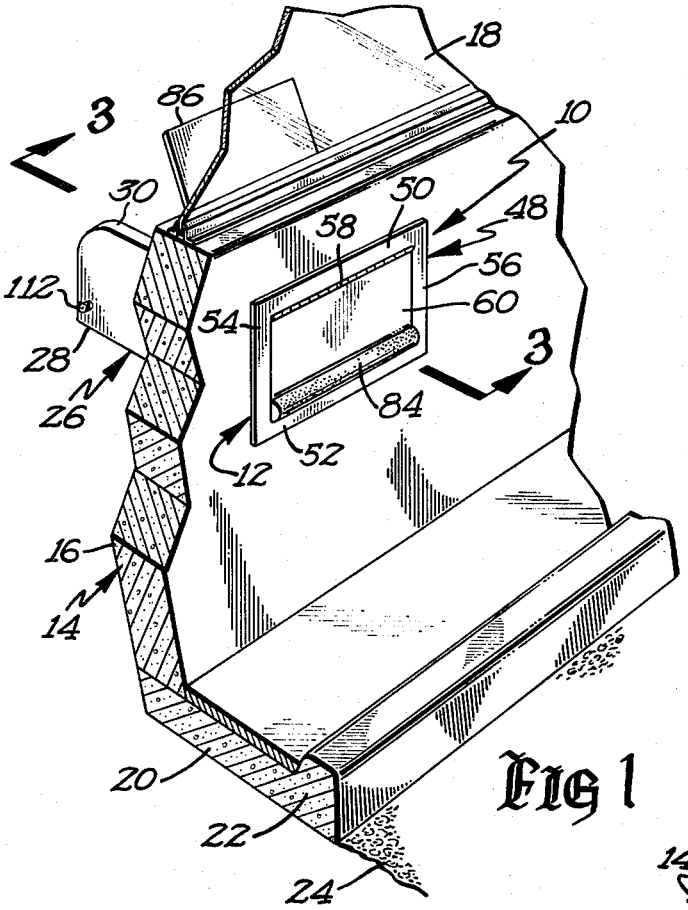
FIG. 1 shows a perspective view of a serving device, according to the teachings of the present invention, in a building, in its second, closed position, with portions of the building broken away.

All figures are drawn for ease of explanation of the basic teachings of the present invention only; the extensions of the figures with respect to number, position, relationship, and dimensions of the parts to form preferred embodiment will be explained or will be obvious from the explanation given. Further, the exact dimensions and dimensional proportions to conform to specific force, weight, strength, and similar requirements will likewise be explained or within the skill of the art after the following teachings of the present invention have been read and understood.

Where used in the various figures of the drawings, the same numerals designate the same or similar parts. Furthermore, when the terms "right," "left," "front," "back," "vertical," "horizontal," "first," "second," "top," "bottom," and similar terms are used herein, it should be understood that these terms have reference only to the structure shown in the drawings as it would appear to a person viewing the drawings and are utilized only to facilitate describing the invention.

DESCRIPTION

In the figures, a device, according to the teachings of the present invention, for serving merchandise from a space or building, with the merchandise being located in the interior of the space or building, to a person desiring to receive such merchandise and being located outside of the space or building, generally designated 10, is shown as mounted in an aperture 12 in wall 14. Generally, wall 14 includes a first portion 16, which may be formed of cement block, and a second portion 18, which may be formed of transparent material such as glass, and may include sliding doors or other features, as are well known in the art. Aperture 12 is shown as formed within first portion 16 of wall 14. The building may also include a slab member 20 extending away from wall 14 and which may end in a curb member 22. A roadway 24 allowing motor vehicles to be driven thereon is further shown next to curb member 22.

Device 10, in the preferred embodiment, includes a frame generally designated 26. Frame 26 is comprised of a rectangular portion 28 arranged to fit aperture 12 in wall 14 and extend into the interior of the building. In particular, rectangular portion 28 defines a frame interior and includes first and second vertically arranged flat pieces or sides 30 and 32, respectively, a horizontally arranged flat piece or bottom 34, a horizontally arranged flat piece or top 36, a first, outside open end 38, and a second, inside end 40 including a vertically arranged piece 42, and an open portion 44. Bottom 34 is interconnected to and between the bottom edges of sides 30 and 32. Top 36 is interconnected to and between the front ends of the top edges of sides 30 and 32. Open end 38 is then formed by the first or outside ends of sides 30 and 32, bottom 34, and top 36. Piece 42 is interconnected to and between the second or inside ends of sides 30 and 32 and interconnected to the second or inside end of bottom 34. In the preferred embodiment, open portion 44 is above piece 42, and end 40 is parallel to end 38. In the preferred embodiment, sides 30 and 32 and bottom 34 extend the full length of portion 28 and top 36 has a length approximately equal to the thickness of portion 16 of wall 14. Therefore, rectangular portion 28 includes an open portion 46 formed adjacent to top 36 and parallel to bottom 34. First open end 38 allows access to the frame interior by persons desiring to receive the merchandise and located outside the building. Portions 44 and 46 of rectangular portion 28 allow access to the interior of frame 26 from the interior of the building.

In the preferred embodiment, sides 30 and 32, bottom 34, top 36, and piece 42 are formed from 1 3/16 inch marine plywood and may be covered with laminated plastic, not shown. Additionally, fur 47 can be provided attached to sides 30 and 32, bottom 34, and top 36 for purposes explained further hereinafter.

Rectangular portion 28 further includes a frame face 48 attached to sides 30 and 32, bottom 34, and top 36 which extends around the entire perimeter of aperture 12. In the preferred embodiment, frame face 48 is formed from heavy gauge stainless steel. Frame face 48 includes top and bottom horizontally arranged pieces 50 and 52, respectively, which are interconnected at their ends with similar vertically arranged pieces 54 and 56. Pieces 50, 52, 54, and 56 include a first member 51 arranged parallel to the face of portion 16 of wall 14 and located exteriorly of portion 16 of wall 14 for overlapping portion 16 around and about aperture 12 for making frame 26 substantially weather tight within aperture 12. Further, pieces 50, 52, 54, and 56 of frame face 48 include a second member 53 attached perpendicularly to member 51 and extending into the interior of frame 26, a third member 55 attached perpendicularly to member 53, and extending in a direction parallel to but opposite to that of member 51, and a fourth member 57 attached perpendicularly to member 55 and extending into the interior of frame 26 in a parallel manner to member 53. It should then be noted that members 53, 55, and 57 form a stepped portion 59 in each of pieces 50, 52, 54, and 56 for purposes to be described hereinafter. It should also be noted that frame 26 has a shape corresponding to and including stepped portion 59.

A door 60 is pivotally mounted to top piece 50 of frame face 48 by hinge 58 and is arranged to partially close open end 38 of rectangular portion 28. In the preferred embodiment, door 60 is formed from heavy gauge stainless steel. Door 60 further includes an inside rolled edge defining a trough member 62 on its lower edge adjacent frame face piece 52 and which extends the full length of door 60. Trough member 62 holds and contains weather stripping 64 for purposes explained further hereinafter. Further included are first and second rollers 66 mounted on opposite sides of door 60 for purposes explained further hereinafter. Door 60 abuts with stepped portion 59 of pieces 50, 54, and 56 of frame face 48 for providing a weather seal therebetween, for providing a door abutment for preventing door 60 from being pivoted beyond its closed position into the interior of frame 26, and for allowing door 60 to be flush with the exterior of portion 16 of wall 14.

Device 10 further includes a drawer, generally designated 68, which may be molded of one piece ½ inch I.S.P. plastic, as shown in the preferred embodiment. Drawer 68 includes first and second vertically arranged flat pieces or sides 70 and 72, respectively, a horizontally arranged flat piece or bottom 74, an open top or access opening 76, a first, generally open outside end 78, and a second, inside, vertically arranged flat piece or end 80. Bottom 74 is interconnected to and between the bottom ends of sides 70 and 72. End 80 is interconnected to and between the second ends of sides 70 and 72 and is interconnected to bottom 74 between opening 76 and bottom 74. Opening 76 is defined by the top ends of sides 70 and 72 and of end 80. End 78 is defined by the first ends of sides 70 and 72, of bottom 74, and of opening 76.

In the preferred embodiment, end 78 includes an elongated member 82 having an inside or back surface 81. The portion of member 82 exposed to the exterior of the building may include a stainless steel cover 83 having a resilient bumper 84 attached thereto. Bumper 84 should be made from material which stays soft in any weather, and yet remains firm enough to resist wear and tear. The advantages and operation of cover 83 and bumper 84 will be explained further hereinafter. Member 82 also abuts with stepped portion 59 of pieces 52, 54, and 56 of frame face 48 for providing a weather seal therebetween, for providing a drawer abutment for preventing drawer 68 from being moved beyond its second, closed position into the interior of frame 26, and for allowing member 82 to be flush with the exterior of portion 16 of wall 14.

Foam insulation 85 may be provided between member 82 and door 60 and stepped portion 59 of frame face 48 for further providing a weather seal therebetween. End 80 of drawer 68 may include a handle 183 for purposes explained further hereinafter.

Member 86 for closing a portion of top 76 of drawer 68 is further shown as a second door hingedly mounted by pins 88 attached to sides 70 and 72 of drawer 68. Door 86 may include a member 90 for allowing door to be grasped for opening, such as a finger hole shown in the preferred embodiment.

Figure 4:
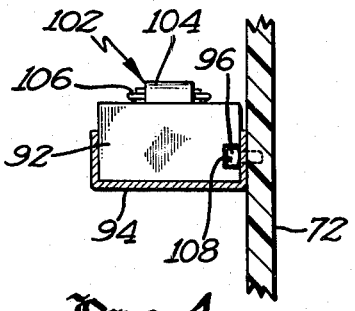
FIG. 4 shows a cross-sectional view of a portion of the device of FIG. 1 according to the section lines 4—4 of FIG. 3.

Drawer 68 further includes a money block 92 movably mounted in trough 94, and, in the preferred embodiment, slidably mounted in trough 94. At least one member 96 having an abutment end, as best seen in FIG. 4, is included outstanding within trough 94. In the preferred embodiment, members 96 are screws which extend from the side of trough 94 and secure trough 94 to side 72 of drawer 68.

Money block 92 includes a first, generally cupped shaped cavity 98 for receiving coins and a second, elongated cavity 100 for receiving paper currency and other paper or lightweight documents such as receipts, invoices, shipping documents or similar means, collectively referred to herein as "money." Money block 92 may further include member 102 for holding the paper currency and lightweight documents in cavity 100, such as a roller 104 pivotally mounted by a wire member 106 to block 92, as shown in the preferred embodiment. Block 92 further includes a slot 108 formed in the side of block 92 corresponding to abutment member 96 for slidably receiving members 96 of trough 94.

Figure 3:
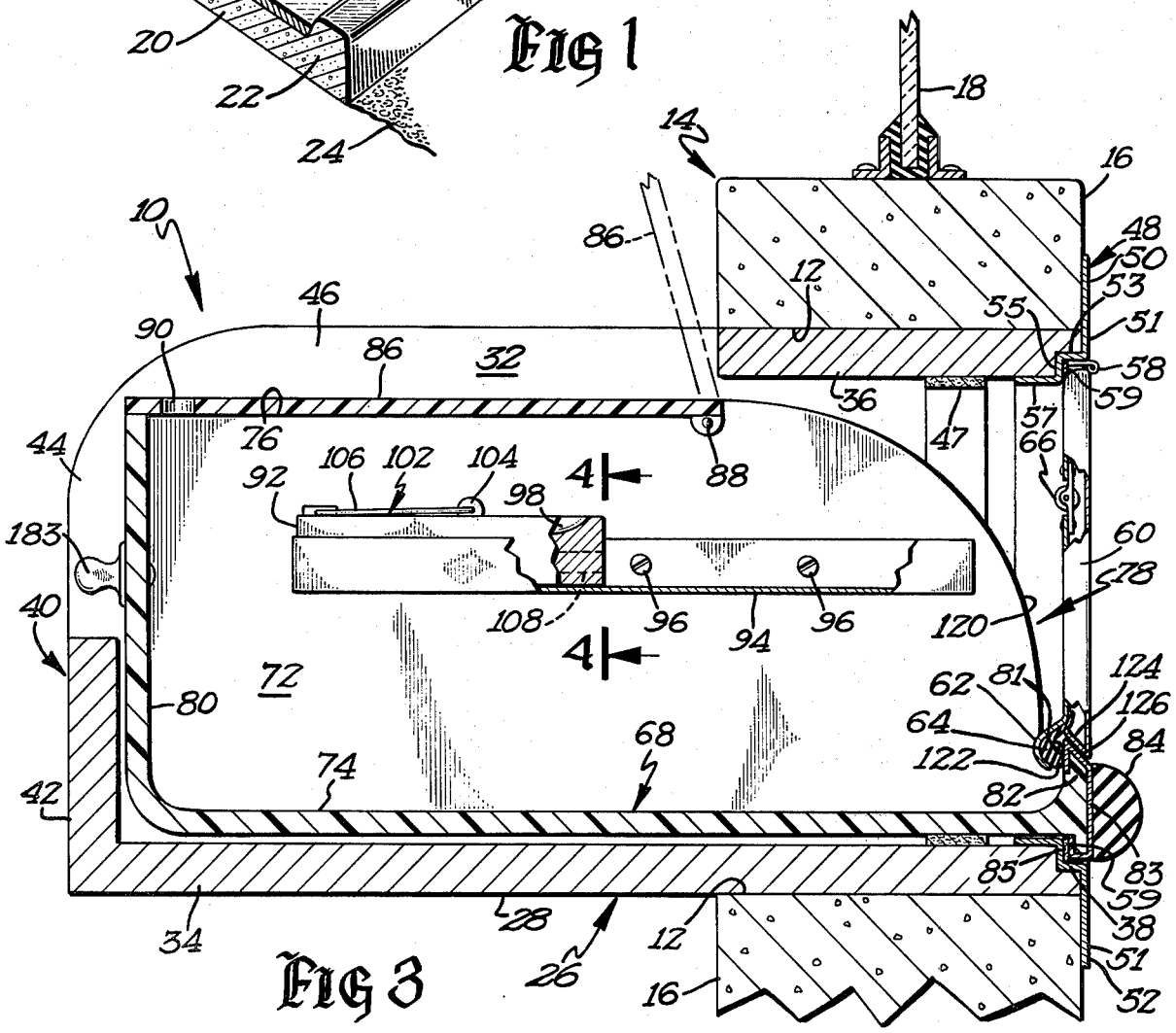
FIG. 3 shows a cross-sectional view of the device of FIG. 1 taken along the section lines 3—3 of FIG. 1.
Figure 2:
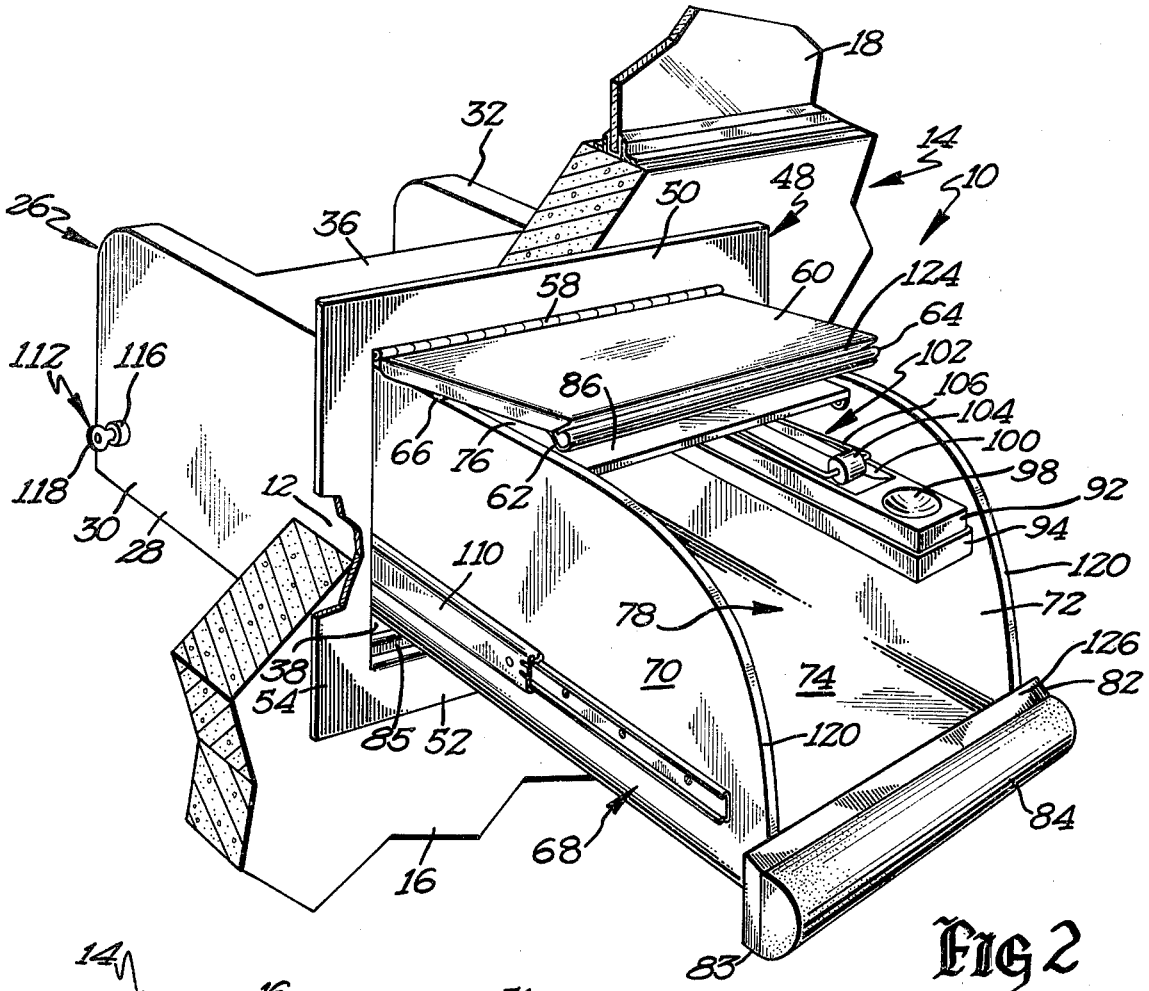
FIG. 2 shows a perspective view of the device of FIG. 1, except in its first, open position.
Figure 5:
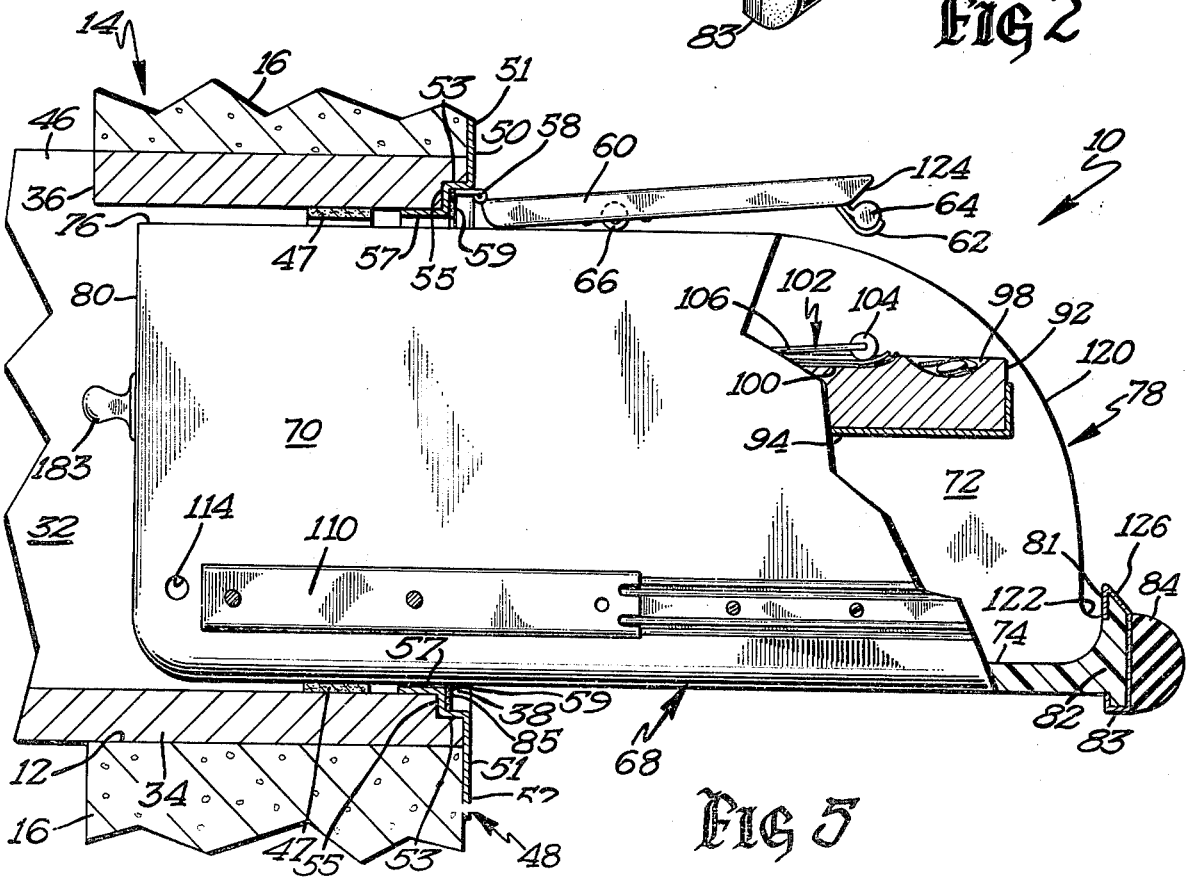
FIG. 5 shows a side view of the device of FIG. 2, with portions thereof being broken away.

It should then be noted that block 92 can then be slidably moved from a first, forward position adjacent to end 78 of drawer 68, as best seen in FIGS. 2 and 5, where members 96 are located within slot 108, to a second, rearward position adjacent to end 80 of drawer 68, as best seen in FIG. 3, where members 96 are located outside the end of slot 108. It can then be appreciated that when block 92 is located in its first position, block 92 cannot be removed from trough 94 in that members 96 and slot 108 engage and prevent the removal thereof. Further, when block 92 is located in its second position, block 92 can be readily removed from trough 94 in that members 96 are located outside of slot 108.

Drawer 68 is movably mounted within the interior of frame 26 for movement from a first, open position extending out of frame 26 to the exterior of the building, as best seen from FIGS. 2 and 5, to a second, closed position located within the frame interior, as best seen in FIGS. 1 and 3. In the preferred embodiment, drawer 68 is slidably mounted to frame 26 by metal drawer slides 110, one set attached to side 30 of rectangular portion 28 and side 70 of drawer 68 and one set attached to side 32 of rectangular portion 28 and side 72 of drawer 68, as is well known in the art of drawer slides. In the preferred embodiment, slides 110 are canted slightly from the horizontal such that drawer 68 is slightly biased towards its second, closed position and such that drawer 68 will return to its closed position from its open position.

A suitable locking mechanism 112 can be provided for locking drawer 68 in its second, closed position. Locking mechanism 112 is inserted into a circular aperture 114 formed in side 70 of drawer 68, and further includes a cylindrical push lock 116 secured to side 30 of rectangular portion 28 and actuable by a key 118. In operation, after drawer 68 has been placed in or has returned to its second, closed position, drawer 68 can be locked in that position by pushing lock 116 inward such that it extends into and is captured within aperture 114 of drawer 68. At that time, key 118 can be turned and removed. Therefore, since lock 116 is located within aperture 114, drawer 68 is locked relative to frame 26 and movement between rectangular portion 28 and drawer 68 is thus prevented.

It should be noted that, when drawer 68 is located in its second, closed position, door 86 can readily be opened allowing access into the interior of drawer 68 but is prevented from being opened when drawer 68 is located in any position other than its second, closed position. Due to the placement of pins 88, i.e, the location of pins 88 when drawer 68 is located in its second position is slightly inside of top 36 of portion 28, door 86 cannot be opened when drawer 68 is not in its second position in that door 86 will abut with top 36 of rectangular portion 28 of frame 26, as best seen in FIG. 5. Thus door 86 prevents air communication between the exterior and the interior of the building when drawer 68 is located in a position other than in its second, closed position. The advantages of this feature will be explained further hereinafter.

Sides 70 and 72 of drawer 68 are partially removed adjacent to end 78 of drawer 68 to form first, arcuate camming surfaces 120 upon which followers, shown in the preferred form as rollers 66, move for opening door 60 as drawer 68 moves from its second, closed position to its first, open position. Therefore, as drawer 68 moves from its second, closed position as shown in FIGS. 1 and 3 to its first, open position as shown in FIGS. 2 and 5, rollers 66 ride upon camming surface 120 of sides 70 and 72 of drawer 68 thus raising door 60 from its closed position as shown in FIGS. 1 and 3, in which position access to the interior of drawer 68 is prevented, to its open position as shown in FIGS. 2 and 5, in which position access to the interior of drawer 68 is allowed. It should be noted that when drawer 68 is in its first, open position, as best seen in FIGS. 2 and 5, the leading edge of drawer 68 defined by member 82 extends beyond the outer edge of door 60 defined by trough member 62 allowing easy access to the interior of drawer 68.

Additionally, sides 70 and 72 of drawer 68 include a second camming surface 122 located behind member 82 for receiving trough member 62 and weather stripping member 64. It can then be noted that when trough member 62 rides into second camming surface 122, it is captured between camming surface 122 and inside surface 81 of member 82 such that weather stripping 64 engages with inside surface 81 of member 82 for providing a substantially weather tight seal between door 60 and member 82 of drawer 68. It should also be noted that door 60 and member 82 have complementary shaped for abutting and mating together, shown as complementary inclined surfaces 124 and 126 formed on door 60 and member 82, respectively, in the preferred form, to further aid in providing a weather tight seal. Additionally, due to the above interrelationship of member 82 of drawer 68 and members 62 and 64 of door 60, it is impossible to open door without simultaneously sliding drawer 68. Therefore, device 10 is very secure from break-in since it is impossible to open door 60 without moving drawer 68, and drawer 68 can be locked in its second, closed position by locking mechanism 112, as explained hereinbefore. It can then be appreciated that, in the preferred embodiment, door 60 and member 82 close first open end 38 of frame 26 when drawer 68 is located in its second, closed position.

Now that device 10 according to the preferred embodiment of the present invention has been explained, the selection of various parameters for the optimized device 10 for use in serving food can be explained. In the preferred embodiment, the size of aperture 12 is approximately 15⅜ inches high and is approximately 20¾ inches wide. Frame 26 is approximately 28 inches long. Drawer 68 is approximately 26¼ inches long. The top surface of bottom 74 of drawer 68 should be approximately 30 inches above the top surface of roadway 24. The leading edge of drawer 68, defined by member 82, extends from 0 inches to 24 inches from frame 26 of device 10.

OPERATION

For the sake of example, it will be assumed that device 10 has been mounted in wall 14 and drawer 68 is in its closed position and money block 92 is located in its first, forward position. Lock mechanism 112 is actuated by key 118 such that drawer 68 is freely slidable relative to frame 26. After an order for food or other merchandise has been received from the customer, drawer 68 is opened from its second position to its first position.

As drawer 68 is moved from its second position, trough member 62 and member 64 are released from between second camming surfaces 122 of sides 70 and 72 and member 82 of drawer 68. Rollers 66 then engage with and roll up on camming surfaces 120 of sides 70 and 72 of drawer 68 thus moving door 60 from its closed position shown in FIGS. 1 and 3 to its open position shown in FIGS. 2 and 5. Handle 183 can be used for moving drawer 68 from its second position to its first position.

At that time, the customer can place the necessary money in money block 92 to cover the cost of his (her) purchase. Drawer 68 is then moved from its first position to its second position. Handle 183 can be used for moving drawer 68 from its first position to its second position.

As drawer 68 is moved from its first, open position, rollers 66 roll down on camming surfaces 120 of sides 70 and 72 of drawer 68 and then trough member 62 and member 64 are captured between second camming surfaces 122 of sides 70 and 72 and inside surface 81 of member 82 of drawer 68. Thus, drawer 68 is in its second, closed position and door 60 is in its closed position as best seen in FIGS. 1 and 3.

Door 86 is then raised from its closed position as shown in solid in FIG. 3 to its open position as shown in phantom in FIG. 3. Money block 92 can then be slid to its second, rearward position, shown in FIG. 3 and can be removed from the interior of drawer 68. The purchase money can then be removed from block 92 and the correct change, if any, then obtained and placed within cavities 98 and 100 of money block 92. Money block 92 can then be repositioned in trough 94 and slid to its first, forward position as shown in FIGS. 2 and 5. It should then again be noted that members 96 and 108 prevent removal of block 92 from trough 94 in the first position but allow removal of block 92 from trough 94 in the second position.

The food or merchandise can then be placed within drawer 68 through portions 44 and 46 of frame 26 and door 86 pivoted to its closed position. At this time, drawer 68 can be moved from its second, closed position as shown in FIGS. 1 and 3 to its first, open position as shown in FIGS. 2 and 5 in a similar manner as described above. The customer can then remove his change from the money block 92 and the food or merchandise from drawer 68. Drawer 68 can then be moved from its first, open position shown in FIGS. 2 and 5 to its second, closed position shown in FIG. 3 in a similar manner as described above.

It should then be noted that if drawer 68 contacts the motorized vehicle of the customer, bumper 84, and not sharp or metal edges, engages the vehicle, thus minimizing or preventing damage to the vehicle.

It can then also be noted that device 10, according to the present invention, allows access to the interior of frame 26 and drawer 68 from the interior of the building. Additionally, due to the split front of drawer 68 created by opening 76, open end 78, and the partially removed portions of sides 70 and 72 forming camming surfaces 120, device 10 allows a person desiring the merchandise and located outside the building easy access to the interior of drawer 68 in any vertical angle. Thus, due to this split front, device 10 allows the person to reach from above or below bottom 74 of drawer 68 allowing use of device 10 for various size vehicles. It can then be appreciated that, due to the easy access to drawer 68 of device 10, the preferred height of device 10 from roadway 24, and other factors, due to the design of the present invention, device 10 is able to serve customers driving various sized motorized vehicles including sports cars having very low levels to trucks, vans, and recreational vehicles having very high levels.

It can then be appreciated that drawer 68, in its preferred form, is fully molded in one piece having 1 inch radius corners, thus allowing easy cleaning and being of a hygienic design. In the preferred embodiment, drawer 68 is impregnated with white color throughout the entire thickness to give drawer 68 a very sanitary and hygienic appearance.

It should be noted that device 10 can be completely assembled ready for installation at the factory. Additionally, device 10 can be readily and easily installed.

It can now also be appreciated that the portions of device 10 exposed to the exterior of wall 14, namely frame face 48 including pieces 50, 52, 54, and 56, door 60, cover 83 of member 82, and bumper 84 are resistent to the elements including wind, sun, rain, and corrosion.

It can then further be appreciated that a substantially weather tight seal between frame 26 and door 60 and member 82 are provided by weather stripping 64 attached to door 60 for engagement with member 82, the complementary mating shapes 124 and 126 formed on door 60 and member 82, foam insulation 85, and stepped portion 59 formed on face frame 48 and frame 26. It can also be appreciated that device 10 provides a substantially complete weather seal. Specifically, frame face 48 includes pieces 50, 52, 54, and 56 providing a weather seal around rectangular portion 28 and thus prevents air circulation within aperture 12 between portion 28 and portion 16 of wall 14. Likewise, the weather tight seal between frame 26 and door 60 and member 82 provides a substantial weather tight seal for closing the first open end 38 of frame 26 when drawer 68 is located in its second, closed position. Further, fur 47 substantially prevents air communication between the exterior and the interior of the building around drawer 68, i.e., between drawer 68 and frame 26.

It can still further be appreciated that, when drawer 68 is in a position other than in its second, closed position as shown in FIGS. 1 and 3, door 86 must be in its closed position and therefore prevents the customer from reaching from the exterior into the interior of the building and also prevents air circulation between the interior and the exterior of the building. Additionally, it can now be appreciated that door 86 can only be opened when door 60 and member 82 closes first open end 38 of frame 26 in that door 60 is closed when drawer 68 is located in its second, closed position, and door 86 can only be opened when drawer 68 is located in its second position. Therefore, at all times, no matter what the position of drawer 68 in frame 26, air circulation is substantially prevented between the exterior and the interior of the building.

Now that the basic teachings of the present invention have been explained, many extensions and variations will be obvious to one having ordinary skill in the art. For example, although device 10 of the present invention is set forth for use in its preferred form for serving food in a fast food type restaurant setting, the application of the teachings of the present invention to similar uses, such as the delivery of mechanical parts, liquor, or grocery items, will be obvious to one skilled in the art after the teachings of the present invention are read and understood.

Additionally, a removable drop-in drawer member can be provided for placement within drawer 68. Therefore, this drop-in drawer member can be removed from device 10 and cleaned or may be of the disposable type to allow easier cleaning of device 10.

Thus, since the invention disclosed herein may be embodied in other specific forms without departing from the spirit or the general characteristics thereof, some of which forms have been indicated, the embodiments described herein are to be considered in all respects illustrative and not restrictive. The scope of the invention is indicated by the appended claims, rather than by the foregoing description, and all changes which come within the meaning and range of equivalency of the claims are intended to be embraced therein.

What is claimed is:

1. Device for serving merchandise from a building having a wall, with the merchandise being located in the interior of the building and the person desiring to receive the merchandise being located outside the building, with the wall including an aperature, comprising, in combination: a frame arranged to fit the aperture of the wall and extending into the interior of the building, with the frame defining a frame interior and including first and second vertically arranged sides, a horizontally arranged bottom interconnected between the sides, a horizontally arranged top interconnected between the sides, a first, outside, open end, and a second, inside end interconnected between the sides and to the bottom, with the sides of the drawer including camming surfaces, with the frame including open portions for allowing access to the frame interior from the interior of the building; a drawer including first and second vertically arranged sides, a horizontally arranged bottom interconnected between the sides, an open top, a first, outside, open end, and a second, inside vertically arranged end interconnected between the sides and to the bottom; means for movably mounting the drawer within the frame interior from a first, open position extending out of the frame to the exterior of the building to a second, closed position located within the frame interior; a first door pivotally mounted to the frame; an elongated member attached to the drawer and extending across the first, open end, with the first door and the elongated member closing the first, open end of the frame when the drawer is located in its second, closed position; a second door pivotally mounted to the drawer, with the pivot axis of the second door being located slightly inside of the top of the frame when the drawer is located in its second, closed position such that the door abuts with the top of the frame when the drawer is located in any position other than in its second, closed position to prevent the second door from being opened when the drawer is located in a position other than in its second, closed position for substantially preventing air communication between the exterior and interior of the building when the drawer is located in a position other than in its second, closed position; and trough means attached to the first door and extending the full length of the first door for interfitting with and being captured between the camming surface and the elongated member when the drawer is in its second, closed position for preventing the first door from opening when the drawer is in its second, closed position.

2. The device of claim 1 wherein the trough means holds and contains weather stripping for providing a weather seal.

3. The device of claim 1 further comprising, in combination: a money block for receiving money; a trough for slidably receiving the money block for movement from a first, forward position to a second, rearward position; a member outstanding within the trough having an abutment end; and a slot, having a shape corresponding to the abutment member, formed in the money block for slidably receiving the abutment member for preventing the removal of the money block from the drawer in its first, forward position and for allowing removal of the money block from the drawer in its second, rearward position.

4. Device for serving merchandise from a space having a separating wall, with the merchandise being located in the interior of the space and the person desiring to receive the merchandise being located outside of the space, with the wall including an aperture, comprising, in combination: a frame arranged to fit the aperture of the wall and extending into the interior of the space, with the frame defining a frame interior and including a first open end and including first means for allowing access to the frame interior from the interior of the space; a drawer including an access opening and an open end; second means for movably mounting the drawer within the frame interior from a first, open position extending out of the frame to the exterior of the space to a second, closed position located within the frame interior; third means for closing the first open end when the drawer is located in its second, closed position; and fourth means for substantially preventing air communication between the exterior and the interior of the space when the drawer is located in a position other than in its second, closed position, with the third means including a first door pivotally mounted to the frame, an elongated member attached to the drawer along its open end, and sixth means for interrelating the elongated member with the first door for preventing the first door from opening when the drawer is in its second, closed position and for providing a substantially weather tight seal between the first door and the elongated member.

5. The device of claim 4 wherein the frame includes a frame face arranged to overlap the wall around and about the aperture for making the frame substantially weather tight within the aperture.

6. The device of claim 4 wherein the drawer includes a bumper adjacent to the open end of the drawer for preventing damage when the drawer is in its first, open position.

7. The device of claim 4 further including fifth means for providing a substantially weather tight seal between the frame and the third means.

8. The device of claim 4 wherein the sixth means includes a camming surface formed on the drawer behind the elongated member; a trough member extending the full length of the door; and weather stripping located within the trough member; with the trough member being captured between the camming surface and the elongated member for providing a substantially weather tight seal and for preventing the door from opening when the drawer is located in its second, closed position.

9. The device of claim 8 wherein the sixth means includes complementary mating shapes formed on the door and on the elongated member for providing a weather seal.

10. The device of claim 7 wherein the fifth means includes a stepped portion formed in the frame, and with the third means abutting with the stepped portion for providing a substantial weather seal.

11. The device of claim 4 wherein the drawer includes a camming surface and the door pivotally mounted on the frame includes a follower for movement upon the camming surface for opening the door as the drawer moves from its second, closed position to its first, open position.

12. The device of claim 4 wherein the fourth means comprises: a door mounted to the drawer, with the door being prevented from opening when the drawer is located in a position other than in its second, closed position.

13. The device of claim 12 wherein the door is mounted such that when the drawer is located in any position other than in its second, closed position, the door abuts with the frame such that the door is unable to be opened unless the drawer is located in its second, closed position where the door does not abut with the frame.

14. The device of claim 4 further comprising, in combination: a money block for receiving money; means for movably mounting the money block within the drawer from a first, forward position to a second, rearward position; and means for preventing removal of the money block from the drawer in its first, forward position and for allowing removal of the money block from the drawer in its second, rearward position.

15. The device of claim 14 wherein the means for movably mounting the money block comprises: a trough for slidably receiving and mounting the money block and wherein the removal preventing means comprises: a member having an abutment end outstanding within the trough; and a slot having a shape corresponding to the abutment member formed in the money block for slidably receiving the abutment member when the money block is moved to its first, forward position.

16. The device of claim 4 further comprising means for locking the drawer relative to the frame for preventing the drawer from being moved from its second, closed position comprising, in combination: an aperture formed in the drawer, and a push lock secured to the frame such that the drawer can be locked in its second, closed position by pushing push lock such that it extends into the aperture.

17. The device of claim 4 wherein the drawer is molded of one piece plastic having approximately 1 inch radius corners for allowing easy cleaning and for reducing manufacturing expense.

18. The device of claim 1 wherein the drawer includes a bumper adjacent to the open end of the drawer for preventing damage when the drawer is in its first, open position.

19. The device of claim 1 wherein the drawer is molded of one piece plastic having approximately 1 inch radius corners for allowing easy cleaning and for reducing manufacturing expense.

20. The device of claim 1 wherein complementary mating surfaces are formed on the first door and on the elongated member for providing a weather seal.

* * * * *